US005353777A

United States Patent [19]

Fincher

[11] Patent Number: 5,353,777

[45] Date of Patent: Oct. 11, 1994

[54] COMPOUND BOW WITH DIMINISHING DRAW WEIGHT AND QUICK TAKE DOWN FEATURES

[76] Inventor: Hollis W. Fincher, Rte. #5 Box 443, Fayetteville, Ark. 72701

[21] Appl. No.: 997,598

[22] Filed: Dec. 28, 1992

[51] Int. Cl.[5] ..... F41B 7/00; F41B 5/10

[52] U.S. Cl. ..... 124/16; 124/23.1; 124/25.6

[58] Field of Search ..... 124/16, 23.1, 24.1, 124/25.6, 86

[56] References Cited

U.S. PATENT DOCUMENTS

| | | | |
|---|---|---|---|
| 2,714,377 | 8/1955 | Mulkey . | |
| 3,486,495 | 12/1969 | Allen . | |
| 3,744,473 | 7/1973 | Nishioka . | |
| 3,812,835 | 5/1974 | Smith . | |
| 3,981,290 | 9/1976 | Islas . | |
| 4,207,859 | 6/1980 | Scholten | 124/25.6 |
| 4,287,867 | 9/1981 | Islas . | |
| 4,756,295 | 7/1988 | Guzzetta | 124/25.6 X |
| 4,781,168 | 11/1988 | Lester | 124/25.6 |
| 4,803,970 | 2/1989 | Mattheck et al. . | |
| 4,858,588 | 8/1989 | Bozek | 124/25.6 X |
| 4,989,577 | 2/1991 | Bixby | 124/25.6 |
| 5,054,463 | 10/1991 | Colley et al. | 124/25.6 |
| 5,150,699 | 9/1992 | Boissevain | 124/25.6 |

*Primary Examiner*—Randolph A. Reese
*Assistant Examiner*—John Ricci

[57] ABSTRACT

A spring loaded compound bow having a diminishing draw weight and quick take down feature is comprised of rotatable housings suspended from axles through each bifurcated end of a bow riser having a channel running lengthwise through it to accommodate synchronizing cables which cause the housings to rotate inward in opposite directions. A pair of bow limbs are suitably fashioned to conform to the contour of each housing and is secured by a nut and bolt system which also serves to attach the synchronizing cables to the housings. Within each housing is an energy storing device which is activated by a variable ratio energy transmitting device also located within the housings. A bow string connects the limb tips, one to another. As the archer grasps the riser handgrip and pulls the string, the limbs begin to rotate the housings inwardly, causing the variable ratio energy transmitting device to compress the energy storing device, thus storing the energy necessary to propel the arrow when the string is released. A wrench turns the housing axle causing cam lobes on the axle to force the energy storing device against the variable ratio energy transmitting device thus increasing or decreasing the bow's drawing weight.

5 Claims, 5 Drawing Sheets

COMPOUND BOW WITH DIMINISHING DRAW WEIGHT AND QUICK TAKE DOWN FEATURES

FIELD OF INVENTION

This invention relates to archery bows, more specifically, compound archery bows with quick take down capabilities.

BACKGROUND OF THE INVENTION

Since the beginning of Creation, archery has played an important part in the lives of men. The bow has been a weapon of self-defence and warfare, and until recent times, a primary tool for big game hunting. Today, archery is used extensively for indoor and outdoor target shooting, recreational sport and big game hunting. The bow's limited range capabilities and quiet report make it an ideal tool for this purpose. Until recent times the bow has had two basic configurations, the long bow and the short recurve composite bow with extensive variations of each type bow. The basic bow materials are wood, or wood backed with sinew, faced with horn, while some heavy pulling crossbows were made of steel. Bow designs remained within these limitations until the discovery and development of fiberglass backing and facing, held together with epoxy, and other powerful glues, providing the beginning of modern conventional bow designs, which are greatly refined versions of the older long bow and shorter recurve bow types.

The Allen compound bow, U.S. Pat. No. 3,486,495, Dec. 30, 1969, has been a radical departure from these conventional bow designs, while providing a bow with the benefit of a reduction of force necessary to hold the bow at full draw by using a mechanical advantage provided by an eccentric wheel and cable configuration attached to the tips of a short powerful bow limb.

Another type of bow is the Islas bow, U.S. Patent No. 4,287,867, Sep. 8, 1981, which is basically an Allen type bow with extremely short limbs, with a complex riser mounted eccentric wheel and cable system, providing power to a longer, lighter limb system, which produces a functional bow.

Another type is the Nishioka bow, U.S. Pat. No. 3,744,473, Jul. 10, 1973, which features a pivoting limb mounted at either end of the bow riser, with a cable system for synchronizing the limb movement while bending outwardly mounted springs by various means.

Still another type of mechanical bow is the Mattheck, et al bow, U.S. Pat. No. 4,803,970, Feb. 14, 1989, an ungainly bow which appears to be more suitable for throwing a heavy projectile a short distance, rather than being a suitable archery bow. While the above mentioned bows and others are passable archery bows, there are many undesirable characteristics found in these bows. For example: the Allen type bow has to have a relatively heavy eccentric wheel mounted at the tip of the limb to bend the short powerful limb. As the archer releases the string, the limb violently propels the eccentric wheel and cable system forward, which creates detrimental vibrations in the riser and limbs causing the string and the cable to oscillate while the arrow is leaving the bow, which causes the arrow to react differently with each shot, thus having a detrimental effect on accuracy and also creating a great deal of noise and hand shock to the archer. Still another problem with this type bow is limb splitting near the end, in the cutout which accommodates the eccentric wheel, caused by uneven pull by the cable and string system which are also subject to sudden failure because of the great stress and sudden shock loads imposed upon them.

The Islas bow, while solving some of the problems of the Allen type bow is a complex and ungainly bow with many intricate parts, which must be serviced by highly trained persons having access to a considerable amount of these intricate parts necessary to repair various types of such bows or a lengthy trip back to the factory to have repairs or adjustments made which causes an undesirable burden on the bow owner and the manufacturer. The Nishioka type bow, while being of a less complex nature is ungainly because of its outwardly mounted spring system and also lacks the appeal and beauty required to make this type bow acceptable to most archers. These and other numerous disadvantages inherit in these and other mechanical bows create a need for a new improved and simplified bow having overall appeal and beauty of the short powerful Turkish recurve bows.

OBJECT OF THE NEW INVENTION

The object of this invention is to create a new and novel mechanical bow incorporating the desirable characteristics of the Allen, Islas, and the Nishioka, and other mechanical bows while retaining the symmetrical beauty of conventional non-mechanical recurve bows.

Another object of this invention is to provide an archery bow with a heavy first part draw weight and a second part draw weight that diminishes as the archer nears full draw. Another object of this invention is to provide an archery bow wherein the drawing characteristics are programmable and are more ergonomically proper.

Another object of this invention is to provide a bow with the working parts enclosed within housings which are activated by the bow limbs.

Another object of this invention is to provide an archery bow whereby drawing weight adjustment is accomplished by cam action against the energy storing spring, by turning the primary axle by wrench means.

Another object of this invention is to provide a bow with quickly detachable and easily replaceable limbs that conforms to the housing contours, thus providing a bow with quick take down capabilities.

Another object of this invention is to provide an archery bow that a person of average mechanical abilities can disassemble, repair, and reassemble, thus saving time and expense of returning the bow to the factory or repair shop.

Another object of this invention is to provide an archer's bow that by nature of its new, novel design, and precision parts cannot readily be improperly assembled and is self adjusting.

Another object of this invention is to provide an archery bow of novel design, with its working parts being few in number, while being overly strong in design and construction without adversely effecting the operation of the bow, thus almost entirely eliminating bow failure at inopportune times.

Another object of this invention is to provide an archery bow with synchronizing cables that are relatively lightly stressed, and are readily made from cable stock thus making factory made cable harness systems obsolete, and are concealed in the riser.

Another object of this invention is to offer a new mechanical bow designed from a different concept and theory, thus allowing those craftsmen skilled in the art of bow design, a different basic embodiment whereby the most advanced and modern materials such as high tinsel strength aluminum, steel, graphite, boron, kevlar, and other high strength materials could be more effectively incorporated throughout the bow, thus providing a smoother, quieter, more durable, and shock free bow of greater mechanical excellence and of highest quality.

And still another object of this invention is to create a new and novel bow for archers who find the bows of the present art less than perfect.

Still further objects and advantages will become apparent from a consideration of the ensuing description and drawings.

BRIEF DESCRIPTION OF DRAWING FIGURES

DETAILED DESCRIPTION

Figure 1:
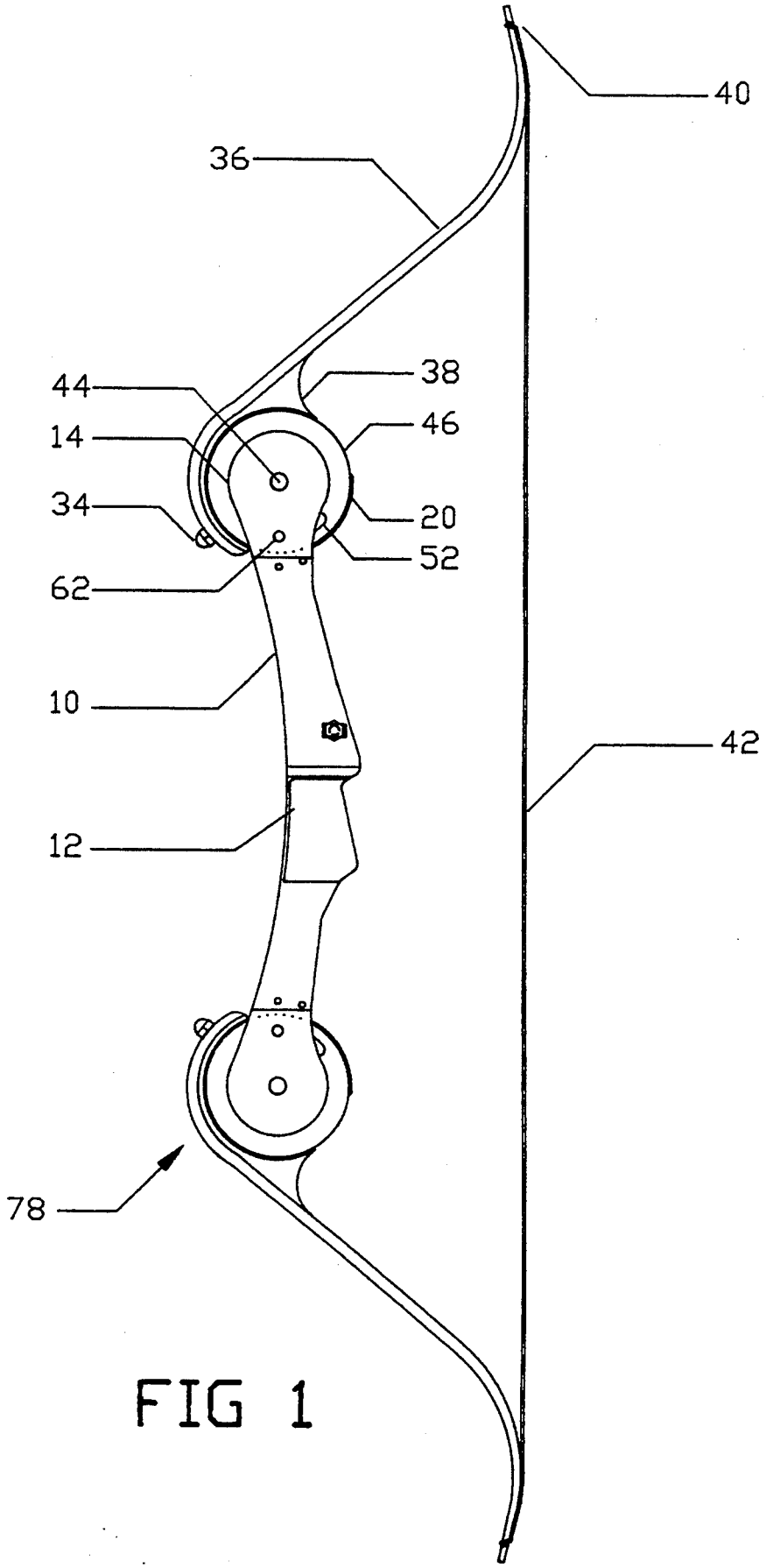
FIG. 1 shows a side elevation of the preferred embodiment of the invention.
Figure 2:
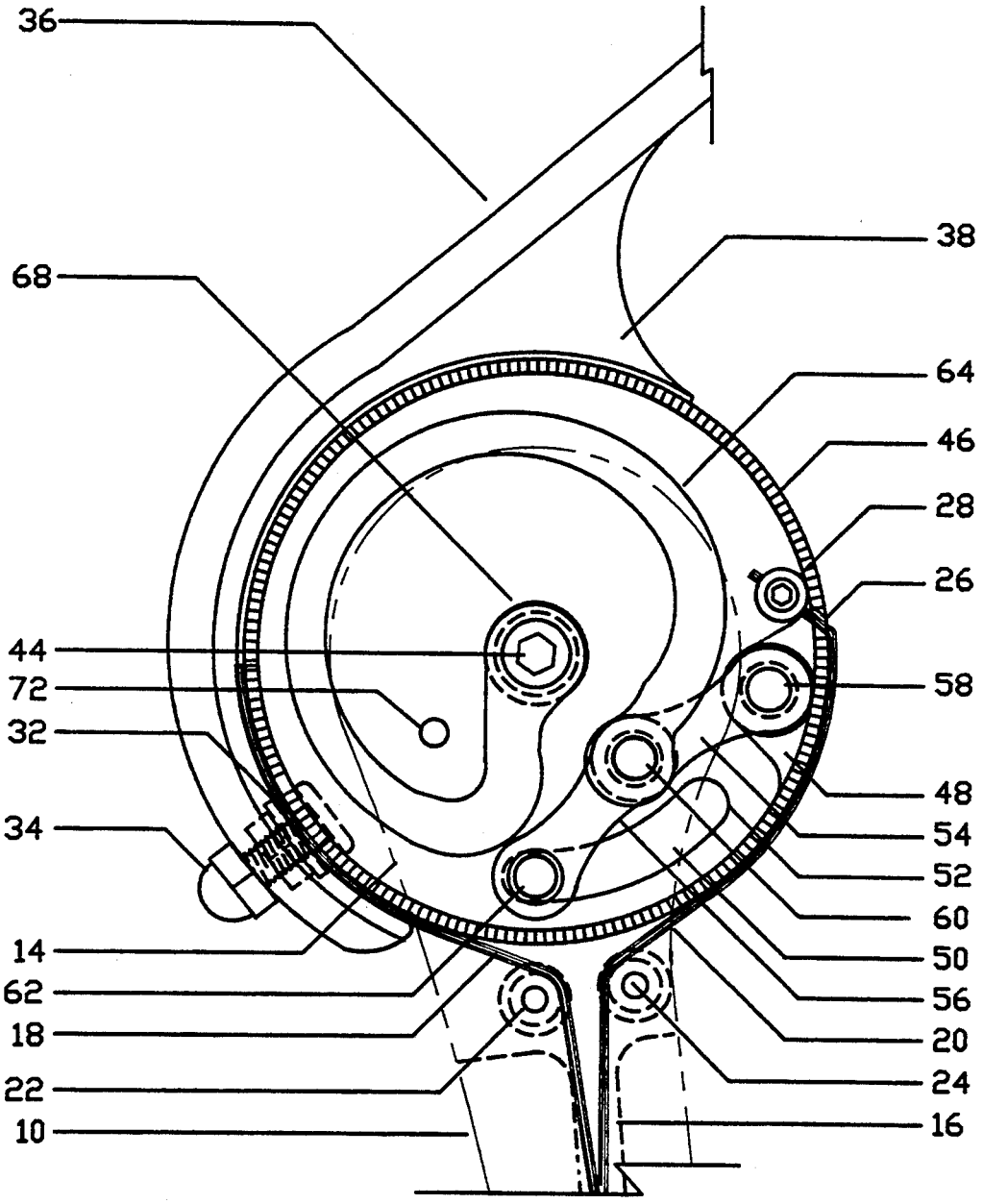
FIG. 2 is a side view, in cross section, of an upper housing showing attachment to the riser and upper limb.
Figure 3:
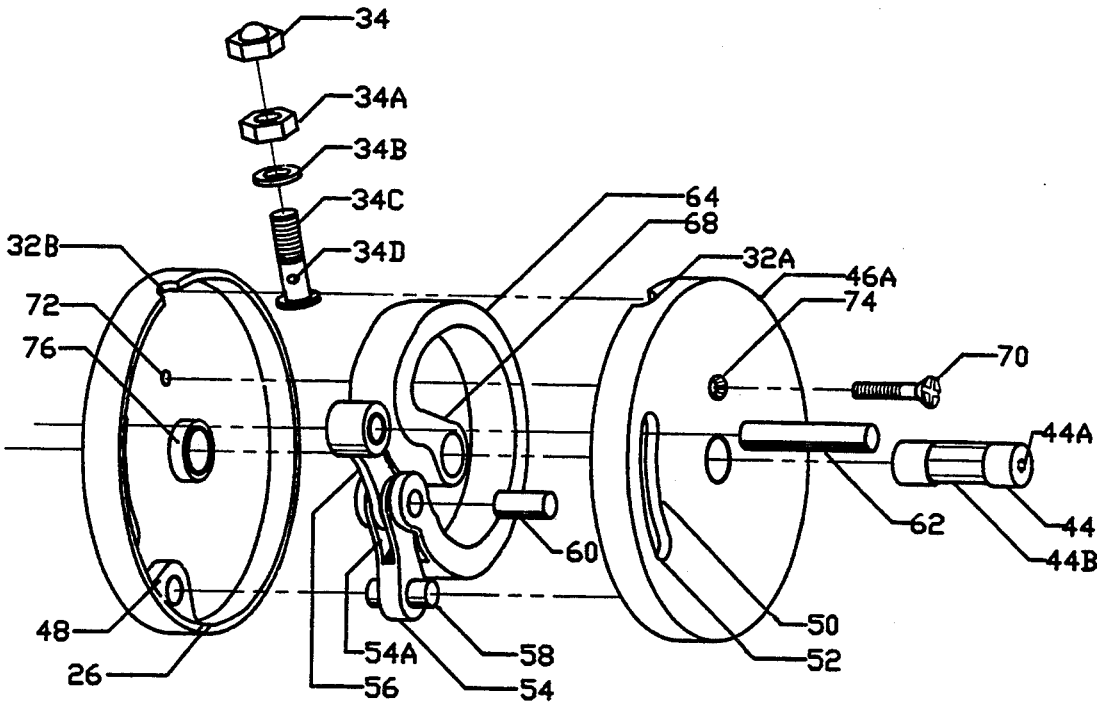
FIG. 3 is an exploded view of a housing assembly.
Figure 4:
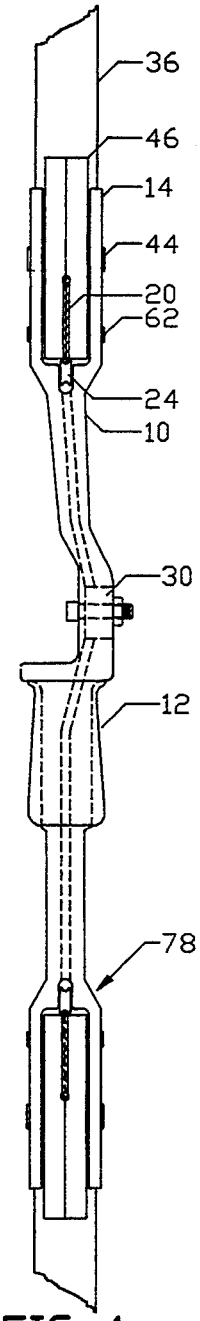
FIGS. 4–7 are respective front, back, left, and right views of the invention (showing only a portion of the limbs)
Figure 5:
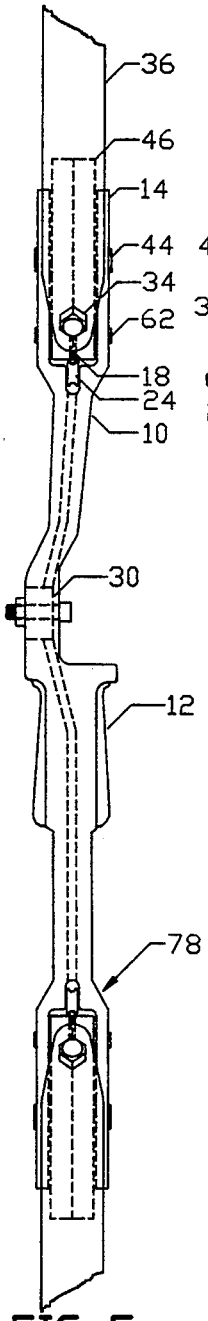
Figure 6:
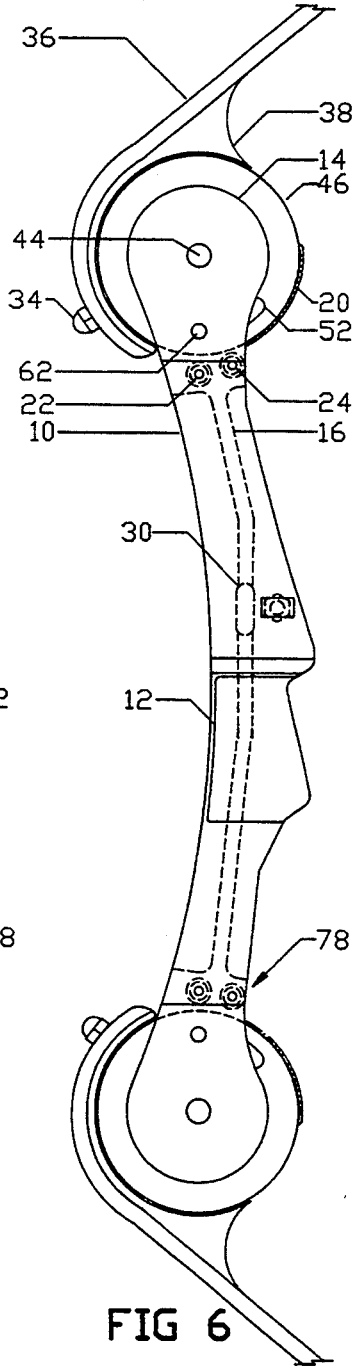
Figure 7:
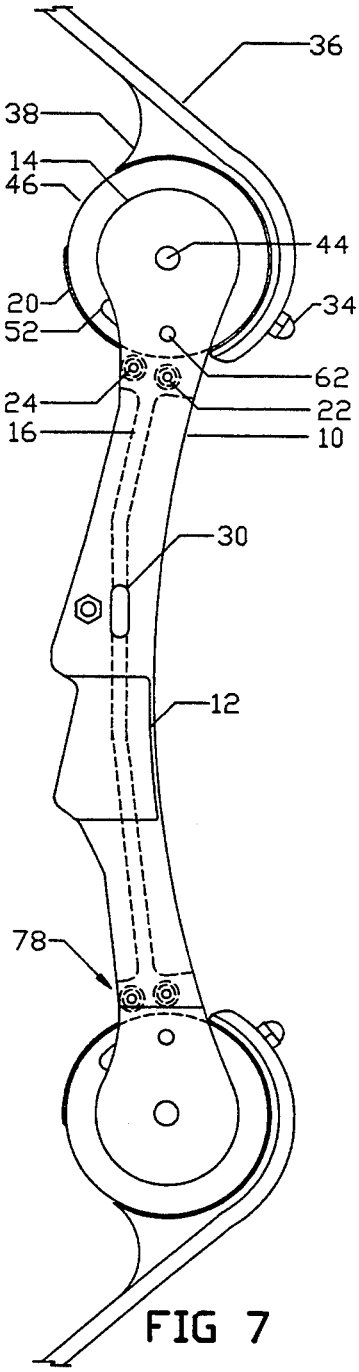

The invention will be more clearly understood from the following detailed description read in conjunction with the accompanying drawings, where in FIG. 1 illustrates an overall elevated view of a preferred embodiment. FIG. 2 shows a side view of the upper mechanism of the invention. Here after, only the bow riser 10, riser hand grip 12, and the upper mechanical assembly will be described, as the lower assembly is comprised of the same parts. FIG. 2 shows a bifurcated end of the riser 14, synchronizing cable channel 16, synchronizing cables 18 and 20, cable support roller and axle 22 and 24, synchronizing cable clearance hole 26, cable stop fastener 28, which prevents synchronizing cables 18 and 20 from pulling through the housing 46. A limb and cable fastener bolt hole 32, in housing half 46. The limb and cable fastener assembly 34. The upper bow limb is 36. A portion of the limb that conforms to the housing 38. Not shown in FIG. 2 are the limb tip and string notch 40, and the bow string 42. The housing support axle is 44. The housing halves 46A and 46B are joined together with housing joining fastener 70, to make a single housing unit. The primary link axle lug 48, strengthens that housing portion for accommodating the primary link axle 58, the linkage and energy spring connecting axle 60 joins energy transmitting link 54, the bifurcated end of energy storing spring 66, and secondary energy transmitting link 56 together. The clearance slot 50, clears secondary link axle 62, the clearance slot end 52 serves as a draw length stop when it contacts secondary linkage thrust axle 62. The energy storing spring 64 has a loop 68 for holding the device captive while being activated by the variable ratio energy transmitting device, 54 and 56 combined, when housing 46 is rotated by the bow limb 36, as the archer pulls the bow string 42. An exploded view comprising the upper mechanism is shown in FIG. 3. Sychronizing cable clearance half hole 26, is a clearance hole for the synchronizing cable 20. The limb and cable fastener bolt hole 32 accommodates limb and cable fastener assembly 34. The synchronizing cable passes through 34D to be locked in place by 34A, 34B, and 34C. The limb fastener nut 34 fastens the bow limb 36 to the housing 46. The primary link axle lug 48, which is present in both halves of the housing, connects the housing 46 to the primary energy transmitting link 54 by the primary link axle 58, the clearance slot 50 is also present in both housing halves 46A and 46B. The clearance slot end 52 is programmed to function as a draw length stop by contacting secondary linkage thrust axle 62 after a predetermined amount of limb travel. The housing support axle 44 joins the bifurcated riser end 14, and the housing 46 together allowing the housing to freely rotate the distance allowed by the clearance slot 50. The Allen wrench socket 44A is for rotating the housing support axle cam surfaces 44B against the energy storing spring loop 68, which in turn exerts additional pressure against the energy transmitting linkage device 54 and 56, which is transmitted through the housing 46 to the bow limb 36, to the bow string 42, thus causing an increase in drawing weight. The bifurcated end of energy storing spring 66, the primary energy transmitting link 54, and the secondary energy transmitting link 56 are joined by the linkage and energy spring connecting axle 60. The linkage and energy spring connecting axle 60 is locked into place by an interference fit or more commonly known as a press fit. Slot 54A is a clearance slot for secondary energy transmitting link 56. Housing joining fastener 70 screws into a threaded hole 72 for joining housing halves 46A and 46B together. A countersunk hole 74 allows fastener head 70 to be mounted flush. The housing axle bearing hub 76 which is located in both housing halves, holds anti-friction devices.

DESCRIPTION OF THE INVENTION'S OPERATION

Figure 8:
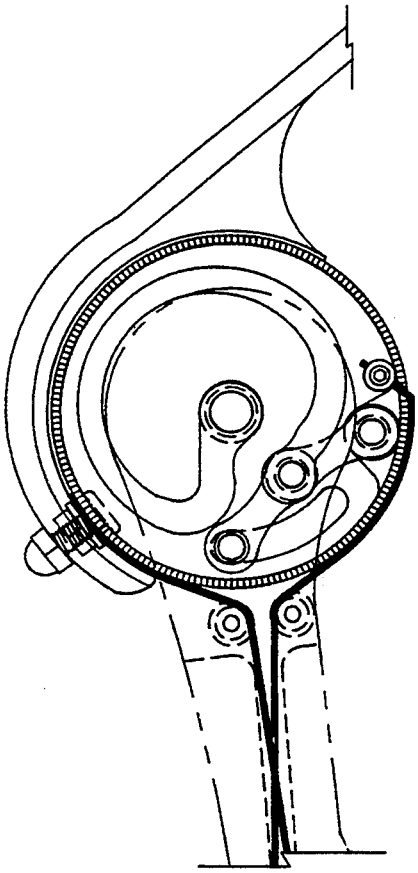
FIGS. 8 and 9 show side views of the upper housing and spring assembly in the rest position and full draw position respectively.
Figure 9:
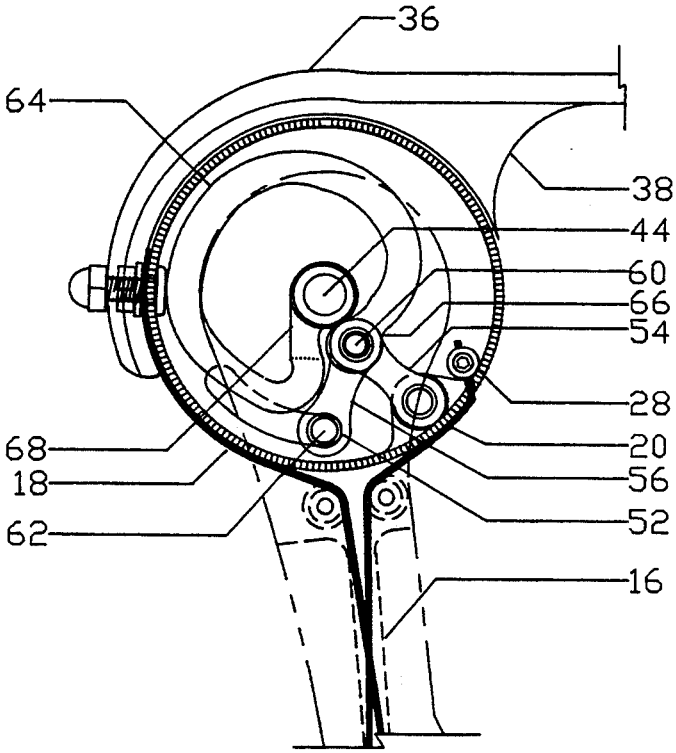

Please refer to the drawings FIG. 8 and FIG. 9, FIG. 8 is a side view of the upper mechanism at the strung position while FIG. 9 shows the mechanism after it has moved through the full range of the drawing cycle, where it is brought to a predetermined stop by clearance slot end 52 contacting the secondary linkage thrust axle 62.

I will now describe bow action through a full draw cycle. As the archer grasps the bow riser hand grip 12 and pulls the bow string 42, pressure is exerted on the limb tip 40, which is transmitted through the bow limb 36 to the housing 46. The rotational energy of the housing is stopped by the secondary link thrust axle 62, and diverted inwardly by the combined function of the two cooperating linkages 54 and 56, which are connected to the bifurcated end of the energy storing spring 66 by the linkage and energy spring connecting axle 60. As the archer further draws the bow, the linkage system exerts a great force against the energy storing spring 64, which is held captive by the housing support axle 44 which passes through the energy storing spring axle loop 68, causing it to deflect inwardly, the extremely powerful spring being unable to resist the combined leverage of the bow string 42, bow limb 36, and the variable ratio energy transmitting linkages 54 and 56.

As the archer continues to draw the bow, the linkage forces the spring to store energy expended by the archer, a steady increase in draw weight is felt by the archer. The primary energy transmitting link 54 begins to assume an increasing amount of the energy transmitting function while the secondary energy transmitting link 56 continues to guide and control it through the cycle. As the axis of the housing support axle 44, linkage and the energy spring connecting axle 60, and the primary link axle 58 approach alignment, the ratio of energy storage to the rate of limb and housing travel begins to decline rapidly providing a bow with a heavy first part draw weight, and a second part diminishing draw weight characteristics, which continues to diminish until secondary link thrust axle 62 contacts clearance slot end 52, thus ending draw cycle at a predetermined point. To synchronize the upper previously described bow mechanism and the lower mechanism 78, the synchronizing cables 18 and 20 travel lengthwise through synchronizing cable channel 16, and are attached oppositely to the corresponding lower housing unit 78, causing the housings 46 to rotate inwardly. This principle is used extensively on conventional compound bows.

To better orient the reader with the invention, a description of certain parts, material, and dimensions will be given. These parts, materials, and dimensions must not be construed as limitations to the scope of the invention, but only as a further approximate description of the present invention.

The bow riser 10 overall length is 21". Housing support axle 44 center to housing support axle 44 center is 18". Housing support axle 44 is ½" in diameter. The bifurcated end of riser 14 is 3" in diameter. One suitable material for the bow riser 10 is 7075 alloy aluminum. The housing 46 is 4 ¼" diameter. The housing thickness is 1". One suitable material for the housing is 7075 alloy aluminum. Energy storing spring 64, major diameter is 3½",and is of rectangular cross section, approximately ⅜"× ⅝". One suitable material is 5160 alloy spring steel suitably heat treated. It is believed that filament reinforced plastic containing fiberglass, graphite fibers, boron fibers, or a composition of these or other materials could also be fashioned into a suitable energy storing spring. The distance from support axle 44 center to linkage and energy spring connecting axle 60 center is approximately 1 5/32". Housing support axle 44 center to secondary thrust axle 62 center is 1⅝". The center of housing support axle 44 to center of primary link axle 58 is 1 13/16". Primary link axle 58 center to linkage and energy spring connecting axle 60 center is 1 3/32". The primary link axle 58 is held captive in the primary energy transmitting link 54 by an interference fit. The distance from secondary thrust axle 62 center to linkage and energy spring connecting axle 60 center is 1". The primary link axle 58, linkage and energy spring connecting axle 60, and secondary linkage thrust axle 62 can be common hardened dowel pins 5/16" diameter. Overall bow length as shown in FIG. 1, limb tip and string notch 40 to limb tip and string notch 40 is approximately 44". Housing support axle 44 center to limb tip string notch 40 is 15". The bow limb 36 can be fashioned from a variety of materials, such as fiberglass reinforced plastic, or laminated wood and fiberglass, being suitable starting points, with graphite, kevlar, and boron fibers given further consideration.

The synchronizing cable channel 16 can be drilled from each end of the bow riser 10, a suitable distance and then joined by drilling through the synchronizing cable channel window 30. Referring to FIG. 3, anti-friction devices are used in the housing axle bearing hub 76, in both halves of housing 46A and 46B. The primary link axle lug 48 in each housing half 46A and 46B contains an anti-friction device. Primary energy transmitting link 54 and secondary energy transmitting link 56 have anti-friction devices to accommodate linkage and energy spring connecting axle 60. Secondary energy transmitting link 56 also has an anti-friction device for secondary link thrust axle 62. A thin anti-friction device can be used between each side of the housing 46 and the bifurcated riser end 14.

SUMMARY

It will be obvious to those artists skilled in the art of bow design, that my compound archery bow offers many unique and previously unobtainable features which bows of the present art lack, However, for the reader unfamiliar with the art of bow design, I will further describe some of my invention's advantages, As the reader will note in FIG. 1, my bow offers a very pleasant overall appearance, with graceful symmetrical lines, free of outside cable harness and cable guards. The bow can be quickly taken down by using a common bow stringer, for safely transporting on horseback, plane travels, canoe trips, and etc. This bow can be disassembled and reassembled by a person of average skills, which is a great advantage over the present group of bows.

A variety of draw lengths, draw weights, and drawing characteristics can be programmed into the bow by varying the length of the primary or secondary links along with the limb length in conjunction with the housings programmable draw length stop.

The working parts are extremely strong and simple, thus almost entirely eliminating bow failure. Bows of the present art can fail without warning due to the many fragile and highly stressed parts. Many archers will appreciate my invention's unique drawing characteristics and it's quiet and shock free arrow casting abilities. The bow's unique cam draw weight adjustment compliments the bow's overall beauty and uniqueness.

The invention's user friendly characteristics gives the owner a confidence not obtainable with other bows. After many years of redesigning and refining the two commercially available bows, the Allen bow, U.S. Pat. No. 3,486,495 dated Dec. 30, 1969 and the Islas bow, U.S. Pat. No. 4,287,867 dated Sep. 8, 1981, have not been able to escape the stigma of being known as arrow shooting contraptions. Also it has been long felt that a bow with rigid limbs, activated by a spring powered mechanism would produce a superior compound bow, however it is self-evident in Mulkey U.S. Pat. No. 2,714,377 dated Aug. 2, 1955, Nishioka U.S. Pat. No. 3,744,473 dated Jul. 10, 1973, Smith U.S. Pat. No. 3,812,835 dated May 28, 1974, Islas U.S. Pat. No. 3,981,290 dated Sep. 21, 1976, Islas U.S. Pat. No. 4,287,867 dated Sep. 8, 1981, and Mattheck, et al U.S. Pat. No. 4,803,970 dated Feb. 14, 1989 have failed to produce a suitable overall embodiment. It will be obvious to the reader, after reviewing the drawings and descriptions of this disclosure that there is a vast difference in the design, mechanics, and benefits unobtainable with other mechanical bows.

Although the description above contains many specifications these should not be construed as limiting the scope of the invention but as merely providing illustrations of one of a presently preferred embodiment of this invention.

Thus the scope of the invention should be determined by the appended claims and their legal equivalents rather than by the example given.

REFERENCE NUMERAL PART DESCRIPTION

10 bow riser
12 riser hand grip
14 bifurcated riser end
16 synchronizing cable channel
18 synchronizing cable
20 synchronizing cable
22 cable support roller and axle
24 cable support roller and axle
26 synchronizing cable clearance half hole
28 cable stop fastener
30 synchronizing cable channel window
32 limb and cable fastener bolt hole
34 limb and cable fastener assembly also comprising 34A, 34B, 34C, and 34D
36 bow limb
38 contoured bow limb portion
40 limb tip and string notch
42 bow string
44 housing support axle also comprising 44A and 44B
46 housing halves also comprising 46A and 46B
48 primary link axle lug
50 clearance slot for secondary link axle 62
52 clearance slot end serves as housing and draw length stop
54 primary energy transmitting link, 54A is clearance slot for link 56
56 secondary energy transmitting link
58 primary link axle
60 linkage and energy spring connecting axle
62 secondary linkage thrust axle also serves as draw stop
64 energy storing spring
66 bifurcated end of energy storing spring
68 energy storing spring housing axle loop
70 housing joining fastener
72 threaded hole for housing fastener
74 countersink hole for housing joining fastener
76 housing axle, bearing hub
78 complete lower unit, limb, housing, riser, and internal components, etc.

I claim:

1. An archery bow comprising:

a riser with a hand grip, and upper and lower bifurcated ends; a hole through the upper and lower bifurcated ends adapted to receive an axle;

rigid upper and lower bow limbs with outer ends joined to each other with a bow string, and inner ends joined to said riser by energy storage means, each said energy storage means comprising:

a housing rotatably received in each of said upper and lower bifurcated ends by a support axle (44) passing through said housing and captured in said holes;

said inner ends of said limbs affixed directly to a respective upper or lower housing;

a thrust axle (62) anchored to said riser and extending into said housing through a slot (50);

a spring means (64) connected between said support axle and a connecting axle (60);

a first energy transmitting link (54) connected between a primary link axle (58) fixed to the housing, and said connecting axle (60);

a second energy transmitting link (56) connected between said connecting axle and said thrust axle;

whereby, as said bowstring is pulled, said limbs rotate along with their associated housings, to store energy in the spring means.

2. The archery bow of claim 1, wherein said first and second energy transmitting links are arranged to provide draw force let-off after a predetermined amount of draw.

3. The archery bow of claim 1, wherein said spring means is connected to said support axle by an axle receiving loop (68), and said support axle includes a cam means, rotatable with a wrench, to adjust the position of the spring means and thus the bow draw weight.

4. The archery bow of claim 1, wherein said inner ends of said limbs have a surface conforming to their associated housings.

5. The archery bow of claim 1, further comprising a lengthwise channel through the riser; a pair of synchronizing cables pass through the channel and are connected to each housing.

* * * * *